US007866131B2

(12) United States Patent
Kammler et al.

(10) Patent No.: US 7,866,131 B2
(45) Date of Patent: Jan. 11, 2011

(54) VERTICAL BAGGING MACHINE COMPRISING TWO LINEAR MOTORS

(75) Inventors: Roman Kammler, Worms (DE); Ralf Bardtke, Dautphetal (DE); Walter Baur, Grundau (DE)

(73) Assignee: ROVEMA-Verpackungsmaschinen GmbH, Fernwald-Annerod (DE)

( * ) Notice: Subject to any disclaimer, the term of this patent is extended or adjusted under 35 U.S.C. 154(b) by 120 days.

(21) Appl. No.: 12/300,537

(22) PCT Filed: Mar. 28, 2007

(86) PCT No.: PCT/EP2007/002732

§ 371 (c)(1),
(2), (4) Date: Mar. 19, 2009

(87) PCT Pub. No.: WO2007/131573

PCT Pub. Date: Nov. 22, 2007

(65) Prior Publication Data

US 2009/0260333 A1 Oct. 22, 2009

(30) Foreign Application Priority Data

May 12, 2006 (DE) ..... 10 2006 022 193

(51) Int. Cl.
*B65B 57/00* (2006.01)

(52) U.S. Cl. ..... 53/551; 53/451; 53/545; 53/548

(58) Field of Classification Search ..... 53/450, 53/451, 558, 574, 545, 547, 548, 550, 551, 53/552; 310/12.01, 12.04, 12.05
See application file for complete search history.

(56) References Cited

U.S. PATENT DOCUMENTS 5,347,795 A * 9/1994 Fukuda ..... 53/552

(Continued)

FOREIGN PATENT DOCUMENTS

CH 306808 A 4/1955

(Continued)

OTHER PUBLICATIONS

"PCT International Search Report dated Jul. 6, 2007 for PCT/EP2007/002732, from which the instant application is based," 2 pgs.

(Continued)

*Primary Examiner*—Paul R Durand
(74) *Attorney, Agent, or Firm*—Fredrikson & Byron, P.A.

(57) ABSTRACT

The invention relates to a vertical bagging machine (1), equipped with a first linear motor (18) for displacing a transversal seal unit (10) in a first direction, preferably vertically (20), and a second linear motor (19) for executing a displacement in a second direction, preferably horizontally (21), in order to displace a heat-sealing jaw (11) in the latter direction or to cause two heat-sealing jaws (11, 12) to be displaced against one another by means of a gear (22). The linear motors (18, 19) are interconnected (23) by means of a cross formation. Each linear motor (18, 19) consists of a primary part (24, 26) and a secondary part (25, 27). The cross formation (23) forms a stable connection for the linear motors (18, 19) that act in displacement directions running perpendicularly to one another

15 Claims, 8 Drawing Sheets

U.S. PATENT DOCUMENTS

| | | | | |
|---|---|---|---|---|
| 5,540,035 | A * | 7/1996 | Plahm et al. | 53/451 |
| 5,791,126 | A * | 8/1998 | Kammler et al. | 53/546 |
| 6,167,677 | B1 * | 1/2001 | Kammler et al. | 53/75 |
| 6,427,425 | B1 * | 8/2002 | Nakagawa et al. | 53/551 |
| 6,441,515 | B1 * | 8/2002 | Shimura | 310/12.19 |
| 7,329,972 | B2 * | 2/2008 | Ito | 310/12.01 |
| 7,622,833 | B2 * | 11/2009 | Haase et al. | 310/12.01 |
| 7,654,540 | B2 * | 2/2010 | Parison et al. | 280/5.5 |
| 7,659,641 | B2 * | 2/2010 | Miyamoto et al. | 310/13 |
| 7,679,225 | B2 * | 3/2010 | Liu et al. | 310/12.16 |
| 7,745,963 | B2 * | 6/2010 | Jenny | 310/12.01 |
| 7,784,247 | B2 * | 8/2010 | Konno | 53/415 |
| 2003/0093971 | A1 * | 5/2003 | Terminella et al. | 53/133.4 |
| 2003/0126840 | A1 * | 7/2003 | Helwig et al. | 53/551 |
| 2005/0051275 | A1 * | 3/2005 | Kammler et al. | 156/391 |
| 2005/0115201 | A1 * | 6/2005 | Helwig et al. | 53/373.7 |
| 2006/0064945 | A1 * | 3/2006 | Kammler et al. | 53/479 |
| 2006/0075724 | A1 * | 4/2006 | Kammler et al. | 53/451 |

FOREIGN PATENT DOCUMENTS

| | | | |
|---|---|---|---|
| DE | 19535510 | A1 | 3/1997 |
| DE | 19630420 | A1 | 1/1998 |
| ES | 2004422 | A6 | 1/1989 |
| WO | 2006068322 | A1 | 6/2006 |

OTHER PUBLICATIONS

"PCT Written Opinion (translation) dated Jul. 6, 2007 for PCT/EP2007/002732, from which the instant application is based," 5 pgs.
"PCT International Preliminary Report on Patentability for PCT/EP2007/002732, from which the instant application is based," 6 pgs.
"PCT International Search Report dated Jun. 28, 2007 for PCT/EP2007/002733," 12 pgs.
"PCT Written Opinion (translation) dated Jun. 28, 2007 for PCT/EP2007/002733, "11 pgs.
"PCT International Preliminary Report on Patentability for PCT/EP2007/002733,".

* cited by examiner

VERTICAL BAGGING MACHINE COMPRISING TWO LINEAR MOTORS

RELATED APPLICATIONS

This application is a 35 U.S.C. 371 national stage filing from International Application No. PCT/EP2007/002732 filed Mar. 28, 2007, which claims priority to German Application 10 2006 022 193.1 filed May 12, 2006, the teachings of which are incorporated herein by reference.

The invention relates to the construction of packaging machines and in particular a vertical bagging machine. Such packaging machines are sufficiently known.

From DE 195 35 510 A1, a vertical bagging machine comprising a film web drawn off from a supply roll by means of a draw-off unit is known. For this, a forming shoulder serves for forming the film web into a tubular film and a format tube for receiving and filling of the tubular film. A longitudinal seal unit is provided for welding the longitudinal edges of the film web and for generating a longitudinal seam of the tubular film. A transversal seal unit comprising two hot-sealing jaws displaceable against one another serves for generating of transversal seams at the tubular film, and a cutting unit serves for cutting off the generated tubular bags from the tubular film. A mechanism is provided for holding the hot-sealing jaws, as well as a drive for displacing the transversal seal unit to displace the sealing jaws relative to each other.

To open and close the transversal seal unit rapidly, on the one hand, and, in addition, to displace the transversal seal unit up and down, on the other hand, to allow a rapid transversal welding of a continuously displaced tubular film, the drive of this known bagging machine comprises two linear motors, the first linear motor of which is provided for a displacement of the transversal seal unit in a first direction (vertically), and the second linear motor serves for carrying out a displacement in a second direction (horizontally) to displace a hot-seal jaw in this direction or to cause both hot-seal jaws, respectively, to be displaced against one another by means of a gear. For this, the linear motors are interconnected via a connection, and each linear motor consists of a primary part and a secondary part. Gears for generating a hot-seal jaw displacement in opposite directions are known in a large variety.

The known drive has the disadvantage that a part of the one linear motor is directly connected with a part of the other linear motor, which results in a low stability of the whole drive.

The object is underlying to further develop a vertical bagging machine of the type mentioned above such that this disadvantage is eliminated.

The object is solved according to the characterizing portion of claim 1. According to that, as a connection between the linear motors, a cross formation is provided, the two beams of which are arranged transverse to one another. On the opposite sides of the cross formation, on the one side, a part of the one linear motor is attached and, on the other side, a part of the other linear motor on the different beams. On each of the opposite sides, in addition, one guideway is provided in parallel to a beam, respectively. One part of a linear motor is attached to a stationary holder. Its other part is attached on the one side of the cross formation. One part of the other linear motor is attached on the other side of the cross formation, and its other part is displaceable relative to this part, and is connected with the transversal seal unit. On each of the parts which are not attached to the cross formation, at least one cart is provided, respectively, for displacing the part along a guideway.

The proposed innovation has the advantage that the drive is very robust. The two parts of the different linear motors are attached on opposite sides of the cross formation, and form together with the cross formation a robust unit. While one linear motor serves for displacement, preferably for lifting and lowering of the cross formation, by operating the other linear motor, the transversal seal unit is opened and closed. The beams of the cross formation support the parts acting perpendicular to one another of the different linear motors.

Advantageous embodiments of the bagging machine according to the invention are described in the claims 2 to 15.

If, according to claim 2, each of the secondary parts of the linear motors are connected fixed with the cross formation, respectively, then the assembled cross formation is relatively easy to displace and hence with relatively low drive energy. Then a stationary primary part displaces the cross formation. Also, the energy supply and the cooling of the primary part can be designed stationary in an advantageous manner. The second primary part is then displaceable relative to the cross formation. This has the advantage that the primary part's heat can be better dissipated when it is freely displaceable. In addition, its heat expansion does not disturb the cross formation. The same applies to the stationary primary part, the heat dissipation of which hardly heats up the cross formation. A relatively heavily heated cross formation, due to its heat expansion, could result in an inaccurate hot-sealing jaw alignment which could cause leaky transverse seams.

If the guideways are attached to the cross formation (claim 3), then they stabilize the cross formation. A hardened guiding surface increases their service life. For the guideways, slide bearings, antifriction bearings, ball bearings, roller bearings, or guided wheels can be used. Suitable as a guideway are two rails running in parallel to one another (claim 4). They can be connected along their entire length with a beam to give the same a higher stability. In a particularly preferred embodiment, they can be formed as one piece with the two beams or the whole cross formation, respectively, to stabilize even more. Moreover, by gluing the parts of the linear motor to be connected with the cross formation over the entire surface (claim 6), a high stability of the whole drive can be achieved.

The cross formation and the connection to the hot-seal jaws are guided in a secure manner when, according to claim 5, at each part displaceable along a guideway, four carts are provided, wherein always two carts, respectively, are guided along a common rail.

If the cross formation, on each of its opposite sides, has one material cut-out with an edge bordering the same, respectively, then the cross formation is constructed very light. The edges thus increase the rigidity of the cross formation. The whole drive is constructed very compact when the parts connected fixed with the cross formation are each provided in a material cut-out, respectively (claim 8).

If, according to claim 9, the parts connected fixed with the cross formation extend along the respective beam and run between the rails, then a compact sturdy construction is achieved, wherein both beams and hence the cross formation are relatively light. Another weight reduction is obtained when the cross formation is made of a light metal, in particular aluminum or magnesium (claim 10).

If at least one secondary part consists of a row of separate secondary sub-segments arranged next to one another, wherein the segments are each connected with the cross formation by a fastening means (claim 11), then thereby is achieved that components which expand differently due to a heating of the secondary part equipped with magnets do not cause a distortion or deformation, respectively, of the cross formation. Since the secondary part gets warmer than the beam carrying it, the secondary part has a higher heat expansion than the beam, if the materials of the secondary part and the beam are identical, or if the secondary part has a higher coefficient of linear expansion than the beam or the cross formation, respectively. Just by a lose abutting of the secondary sub-segments they are allowed to push against one another after a heat expansion to close all gaps which solely exist for assembly reasons and to compensate overall in this manner a higher linear expansion. Therefore, there is no bending of the cross formation which typically expands less because it is not as warm as the secondary sub-segments.

For assembly reasons, it makes sense that each secondary sub-segment is connected with the cross formation via a separate bottom part or a separate housing (claim 12). Then the material of the bottom part or the housing, respectively, and a gap existing there between are relevant for the thermal linear expansions.

If, according to claim 13, the bottom parts or the housings, respectively, abut closely against one another at room temperature or by forming a gap, and if the material of the bottom parts or the housings, respectively, have a lower, in particular, a considerably lower coefficient of linear expansion than the material of the cross formation, the cross formation again does not warp upon heating of the secondary part and heating by heat conduction to the cross formation. Considerably lower is to be understood such that the cross formation expands due to the heating caused by an operation of the secondary part by a higher length difference than the secondary part. If steel is provided as material for the bottom parts or the housings, respectively, and aluminum is provided as material for the cross formation (claim 14), then, on the one hand, it is achieved that the cross formation is relatively light, and therefore can be displaced without major energy demand, and, on the other hand, that it expands with a higher coefficient of linear expansion than the secondary parts. In this manner, a bending of the cross formation does not occur. Between the secondary parts, a gap is typically not to be provided.

Finally, the linear expansion during heating can be disregarded completely, when, according to claim 15, the bottom parts or the housings, respectively, each abut against one another at room temperature by forming a gap. For the materials typically used in machine construction, such as steel, aluminum, and magnesium, gaps with a width of ca. 10 micrometer are normally sufficient.

For fastening, for example, a screw connection or a local adhesion is suitable.

In the following, the proposed vertical bagging machine is described in more detail by means of figures illustrating exemplary embodiments. In the figures.

Figure 1:
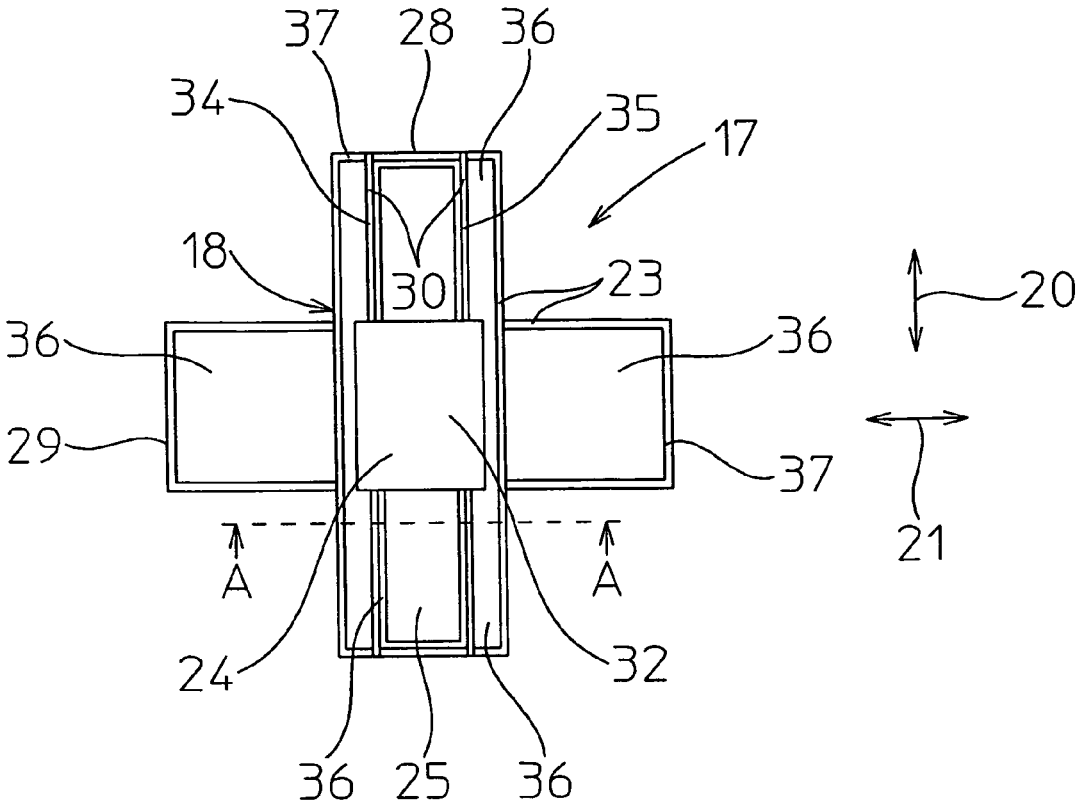
FIG. 1 shows the side view of a cross formation, on the vertically oriented beams of which two rails are formed between which a secondary part of a first linear motor extends, wherein a stationary primary part of this linear motor sits on the rails to displace the cross formation in vertical direction.
Figure 2:
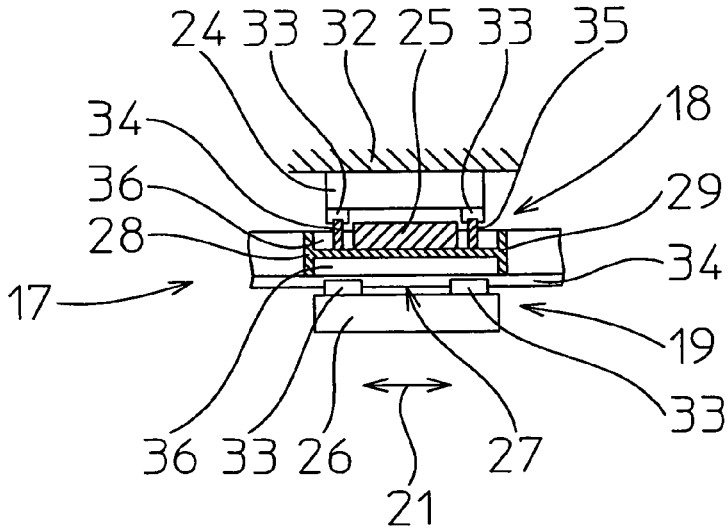
FIG. 2 shows a cross formation sectional taken along A-A of FIG. 1 of the cross formation of FIG. 1.
Figure 3:
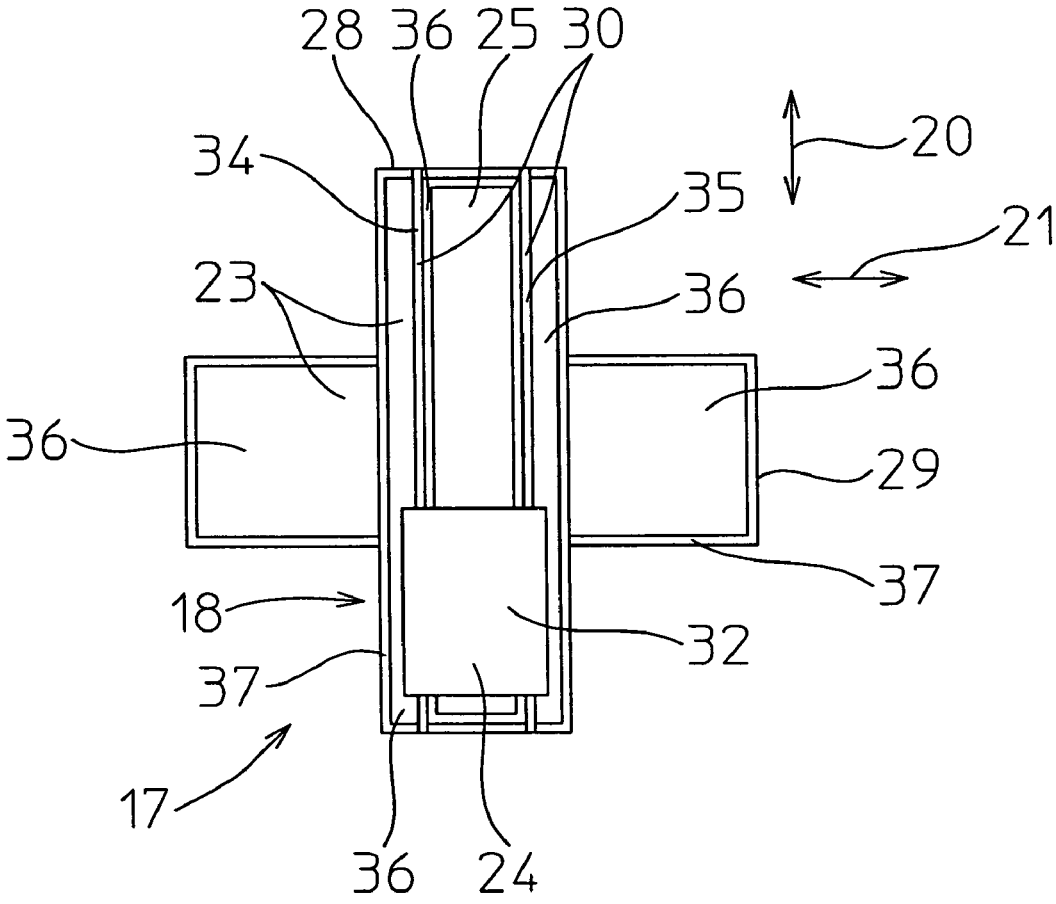
FIG. 3 shows a side view of the object of FIG. 1, but with the cross formation slightly displaced upwards relative to the stationary primary part.
Figure 4:
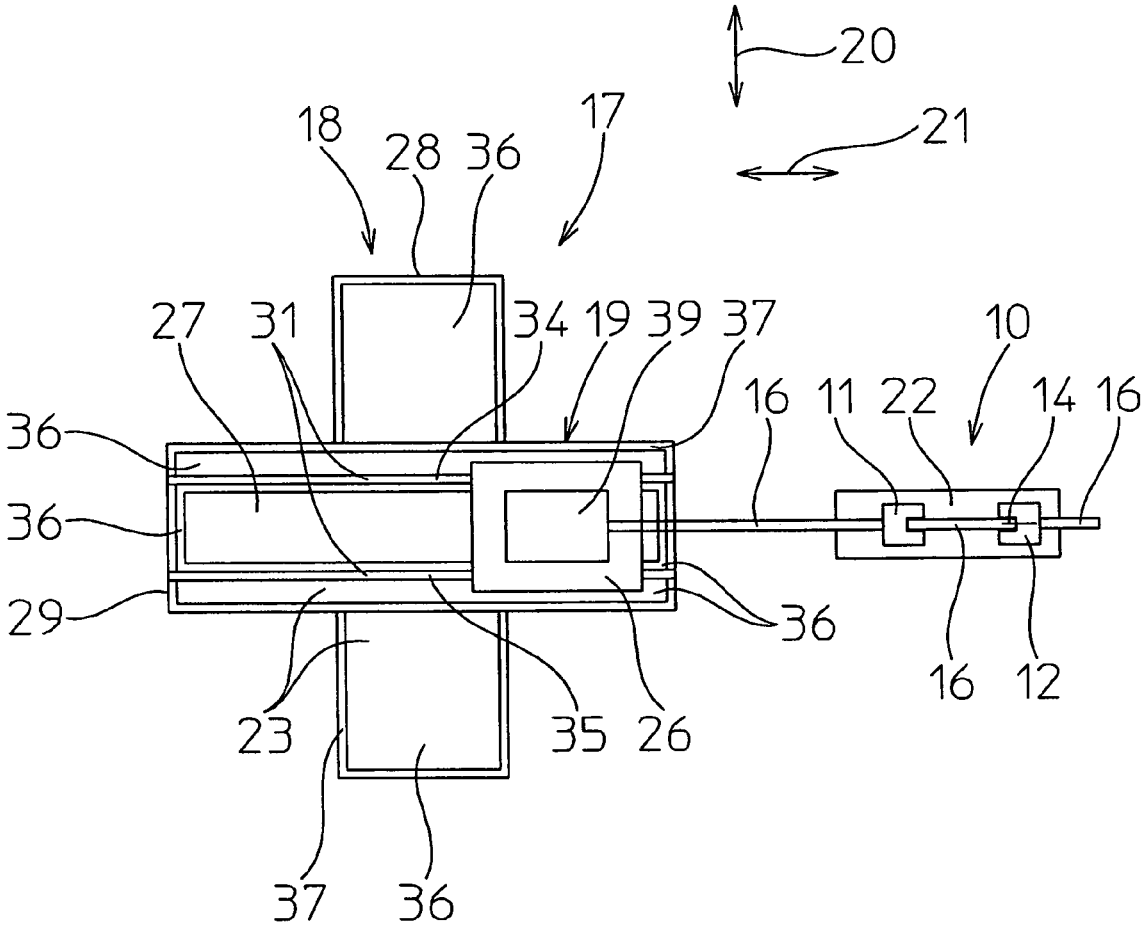
Figure 5:
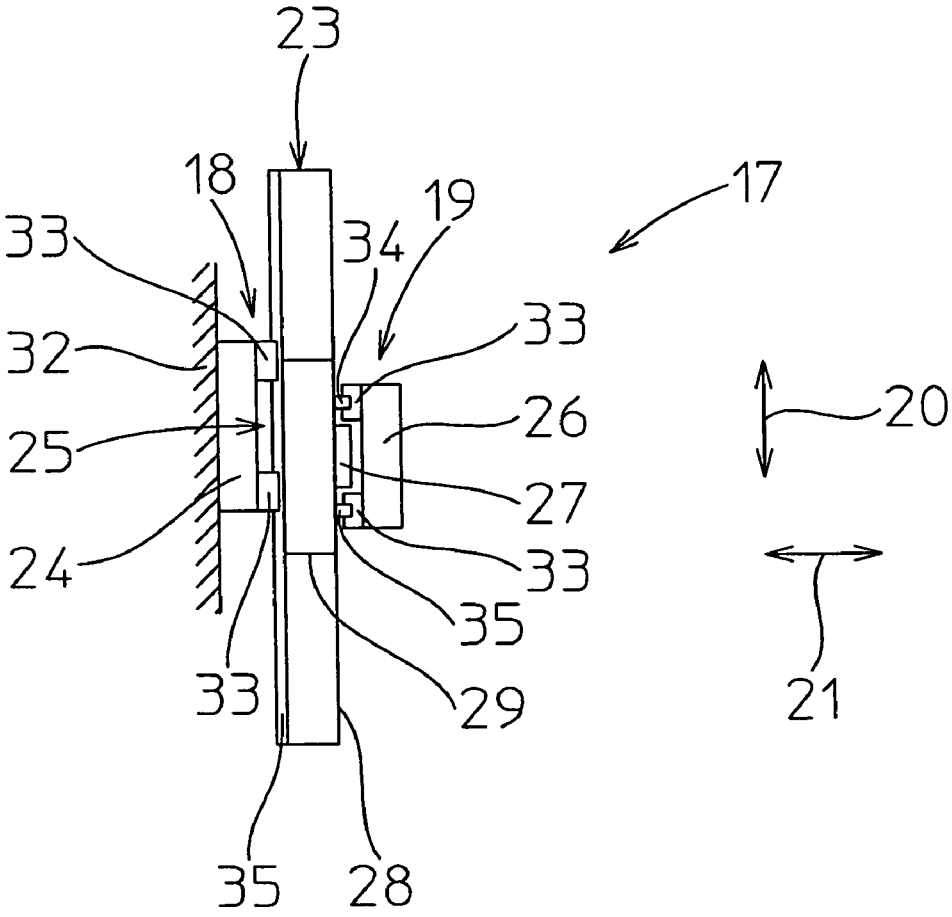
Figure 6:
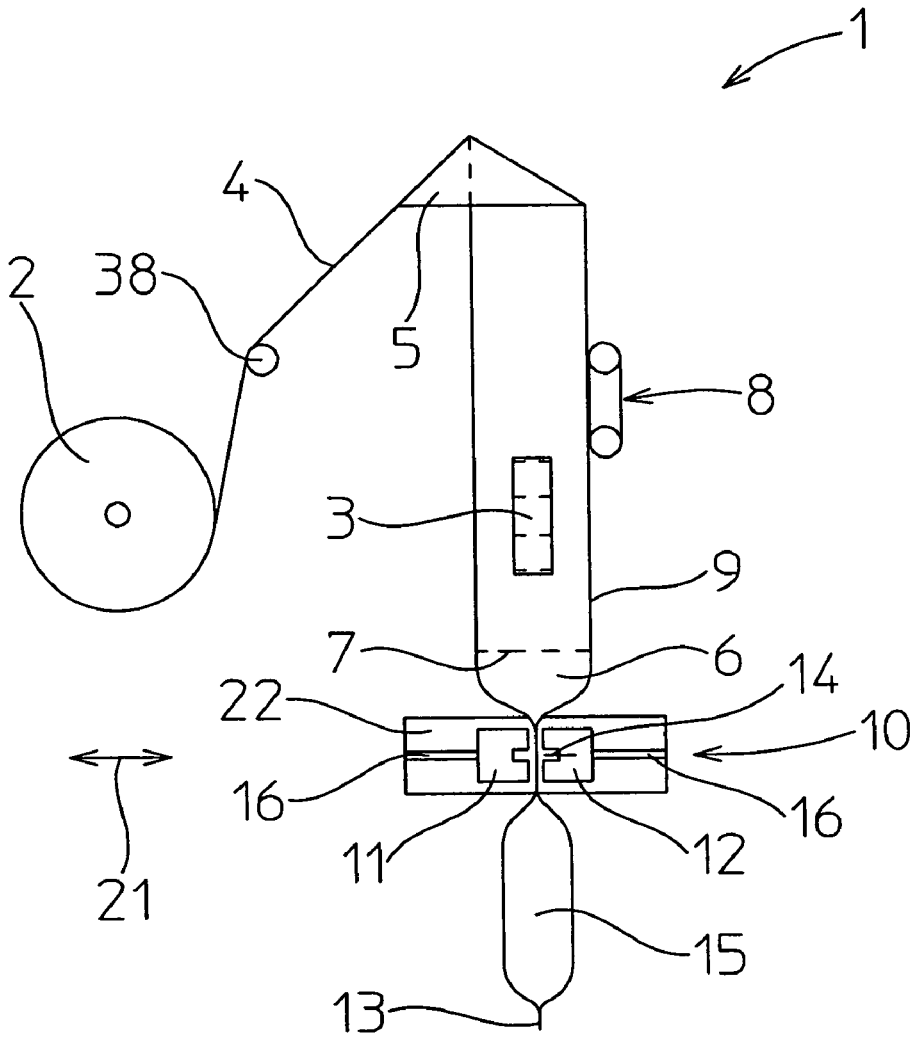
Figure 7:
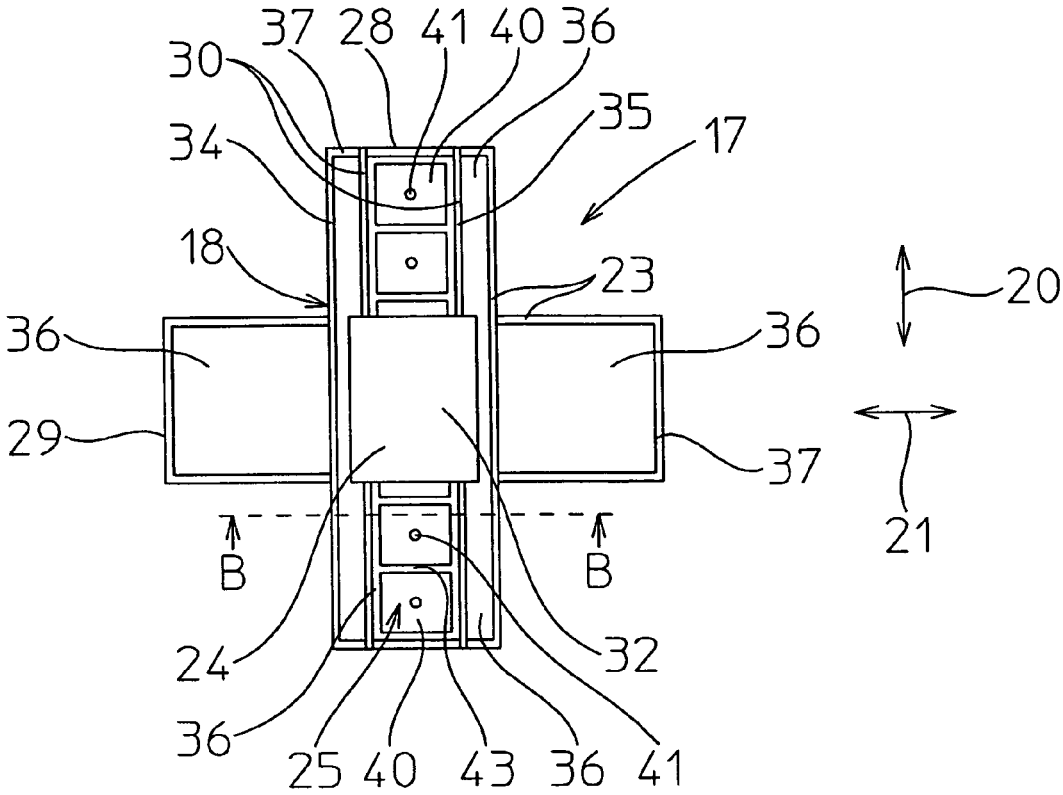
Figure 8:
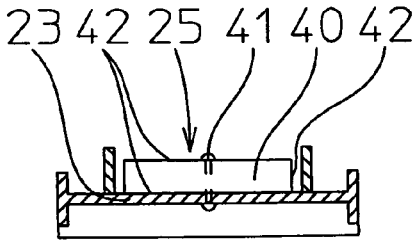
Figure 9:
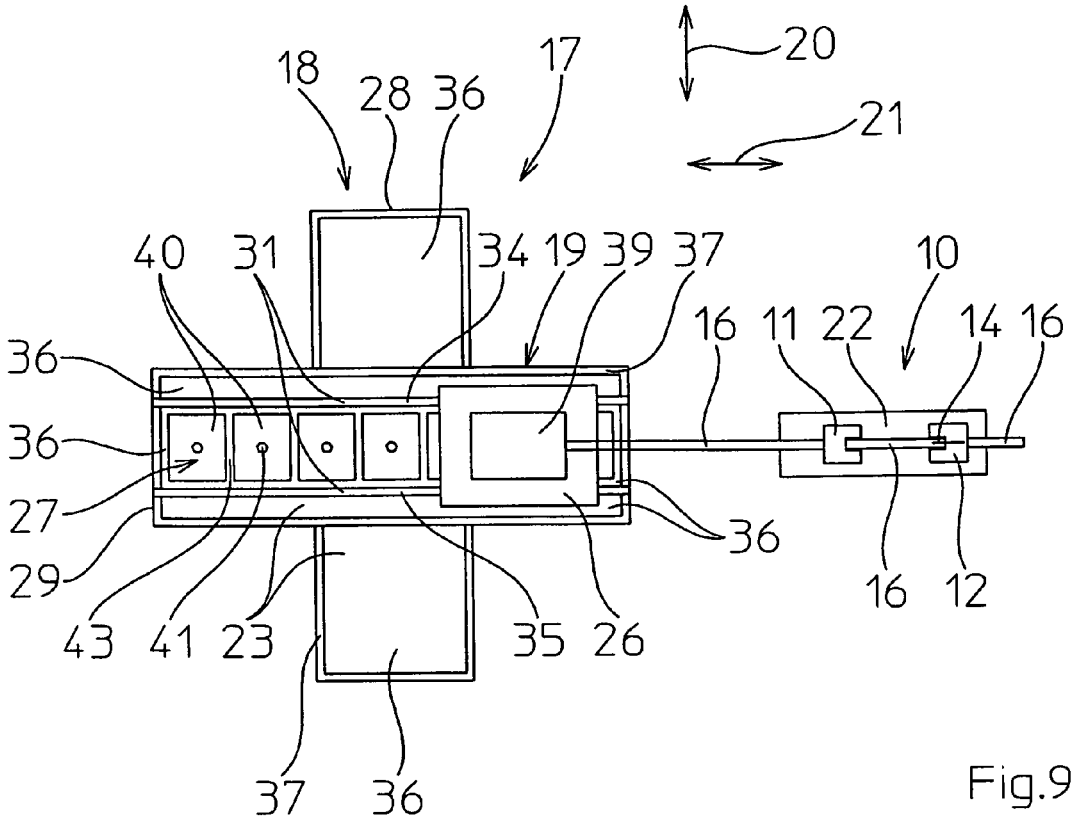
Figure 10:
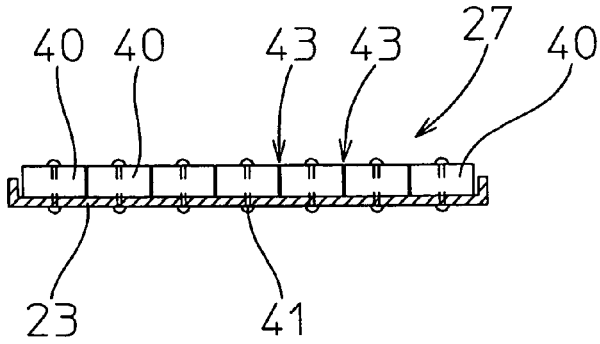
Figure 11:
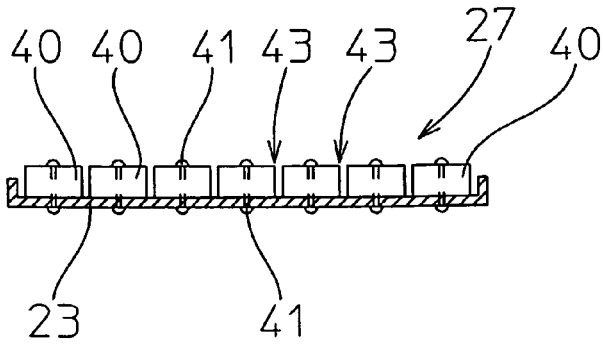
Figure 12:
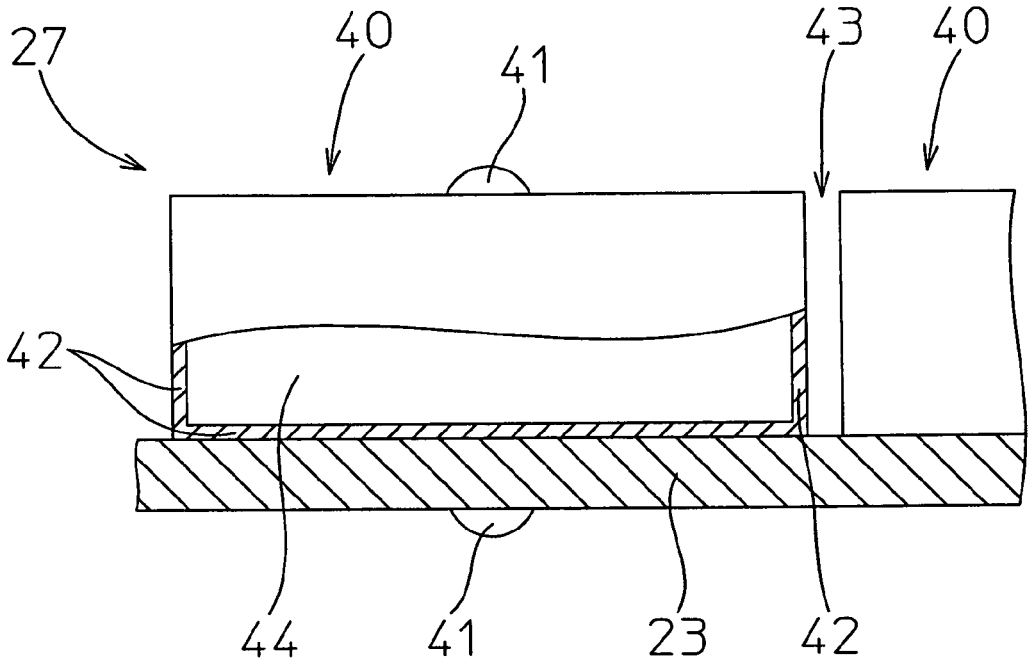

FIG. 4 shows a side view of the backside of the cross formation of FIG. 1, wherein on the horizontally oriented beam, a secondary part of a second linear motor is attached to displace a primary part along horizontally oriented rails, and, in addition, with a transversal seal unit of a vertical bagging machine, the hot-seal jaws of which are displaced towards one another or away from each other by means of a horizontal displacement;

FIG. 5 shows the cross formation of FIG. 1 in a view 90 degrees offset to the view of FIG. 1;

FIG. 6 shows a side view of a vertical bagging machine, the transversal seal unit of which is displaced by means of a drive according to the FIGS. 1 to 5 in vertical direction and, moreover, is opened and closed;

FIG. 7 shows a side view of a cross formation comprising two linear motors according to FIG. 1 acting perpendicularly to one another, but with secondary parts consisting of a row of separate secondary sub-elements, each of them connected with the cross formation;

FIG. 8 shows a cross section of the object of FIG. 7 taken along B-B of FIG. 7;

FIG. 9 shows a side view of the backside of the object of FIG. 7 with the transversal seal unit of FIG. 4;

FIG. 10 shows a cross sectional view of the secondary part for the actuation of the transversal seal unit of FIG. 9 at a low operating temperature of the secondary part;

FIG. 11 shows a cross sectional view of the secondary part of FIG. 10, but at a higher operating temperature, and FIG. 12 shows a cross sectional view and an enlargement of a section of the object of FIG. 11.

In a vertical bagging machine 1 comprising a film web 4 drawn off from a supply roll 2 by means of a draw-off 3 and deflected about a deflection roll 38, a forming shoulder 5 serves for forming the film web 4 into a tubular film 6, and a format tube 7 for receiving and filling the tubular film 6 (FIG. 6). A transversal seal unit 8 is provided for welding the longitudinal edges of the film web 4 and for generating a longitudinal seam 9 of the tubular film 6. A transversal seal unit 10 comprising two hot-seal jaws 11, 12 displaceable against one another serves for generating of transversal seams 13 at the tubular film 6, and a cutting unit 14 serves for cutting off the generated tubular bags 15 from the tubular film 6. A mechanism 16 connected with a fastening means 39 holds the hot-seal jaws 11, 12 (FIG. 4, FIG. 6). By means of a drive 17, the transversal seal unit 10 is opened and closed as well as moved up and down to always generate two transversal seams 13 at the same time and moving along with the tubular film 6 continuously displaced downwards. During this welding process, the hot-seal jaws 11, 12 are closed. Subsequently they are separated from one another and the transversal seal unit 10 is displaced upwards to start there again a welding of transversal seams 13 in a distance of the length of a bag in the compressed tubular film 6.

A drive 17 for displacing the transversal seal unit 10 comprises two linear motors 18, 19 (FIGS. 1 to 5). The first linear motor 18 is provided for a displacement of the transversal seal unit 10 in the vertical direction 20. The second linear motor 19 serves for carrying out a displacement in the horizontal direction 21 to displace the hot-seal jaws 11, 12 in opposite directions against one another in this direction. In doing so, the two hot-seal jaws 11, 12 are caused to be displaced in opposite directions by means of a conventional gear 22 as known per se, when a primary part 26 of the second linear motor 19 is displaced back and forth. The linear motors 18, 19 are interconnected by means of a cross formation 23. Each linear motor 18, 19 consists of a primary part 24, 26 and a secondary part 25, 27. The two beams 28, 29 of the cross formation 23 are arranged transversal to one another. On each of the two opposite sides of the cross formation 23, one secondary part 25, 27, respectively, of a linear motor 18, 19 is attached on a different beam 28, 29. On each of the opposite sides, in addition, one guideway 30, 31, respectively, is provided in parallel to a beam 28, 29. A primary part 24 of the first linear motor 18 is attached to a stationary holder 32. The secondary part 25 of this linear motor 18 is attached to the one side of the cross formation 23. A secondary part 27 of the other linear motor 19 is attached to the other side of the cross formation 23. The primary part 26 of the second linear motor 19 is displaceable relative to this secondary part 27 and is connected with the transversal seal unit 10 to open and close the same. On each of the primary parts 24, 26 which are not attached on the cross formation 23, always four carts 33 are provided for displacing the primary parts 24, 26 along the guideways 30, 31.

The secondary parts 25, 27 are glued to the cross formation 23 to stabilize the same. For reasons of heat expansion, the cross formation 23 and the guideways 30, 31 can be made of a single piece of aluminum, comprising a separate hardened guiding surface, wherein each guideway 30, 31 consists of two rails 34, 35 running in parallel to one another. Alternatively, rails 34, 35 made of hardened steel can be used. The cross formation 23 comprises on each of the opposite sides one material cut-out 36, respectively, with an edge 37 bordering the same. The secondary parts 25, 27 extend across the beams 28, 29, and are each glued between two rails into a material cut-out 36.

While the primary part 24 of the first linear motor 18 displaces upwards and downwards the cross formation 23, and together with it the transversal seal unit 10, the second linear motor 19, by means of a back and forth displacement of its primary part 26 relative to its secondary part 27 and hence to its cross formation, opens and closes the transversal seal unit 10. The secondary parts 25, 27, unlike the primary parts 24, 26, are hardly heated so that the cross formation 23 does not experience a linear expansion due to an excessive heating which concerns the accuracy of the displacement of the hot-seal jaws 11, 12.

In the exemplary embodiment of the FIGS. 7 to 12, the two secondary parts 25, 27 of the cross formation 23 consist of a row of separate secondary sub-segments 40 arranged abutting against one another. The secondary sub-segments 40 are each connected with the cross formation 23 by a fastening means 41. As a fastening means 41 it serves always one screw, respectively. Each secondary sub-segment 40 is connected with the cross formation 23 via a bottom part of a housing 42. The bottom parts, and hence the housings 42, abut closely against one another at room temperature, i.e. when the linear motors 18, 19 are not yet operated (FIG. 10). The material of the housing 42 including the respective bottom part is made of steel. The same has a lower coefficient of linear expansion than the material of the cross formation 23, which is aluminum. Hence, until reaching a respective operational temperature of the linear motors 18, 19 by means of heat emission of the magnets 44, the cross formation 23 forming gaps 43 expands more than the secondary parts 25, 27 (FIGS. 11 and 12). This causes that the cross formation 23 equipped with the secondary parts 25, 27 does not warp so that the guideways 30, 31 remain exactly aligned, and the service life is considerably increased. Thereby, the hot-seal jaws 11, 12 are displaced exactly, and identical transversal seams 13 are generated each time on the tubular film 6. What is said about the first exemplary embodiment (FIGS. 1 to 6) applies accordingly to the exemplary embodiment of the FIGS. 7 to 12.

The term secondary sub-segment 40 is to be understood as a plurality of magnets 40 in one unit, or as one individual magnet 44 in each case. For assembly reasons, it is advantageous to connect the magnets 44 not individually with the cross formation 23 but to screw or glue always a group of magnets 44 to the cross formation 23. A screw connection by means of one single screw for one group which is bordered on the side, two screws next to each other, or one single narrow adhesive path transversal to the longitudinal extent of the secondary part 25, 27 is advantageous. This allows a free expansion of the secondary sub-segments 40 without the cross formation 23 being bent.

The invention claimed is:

1. A vertical bagging machine (1) comprising a film web (4) drawn off from a supply roll (2) by means of a draw-off (3), a forming shoulder (5) for forming the film web (4) into a tubular film (6), a format tube (7) for receiving and filling the tubular film (6), a longitudinal seal unit (8) for welding the longitudinal edges of the film web (4) and for generating a longitudinal seam (9) of the tubular film (6), a transversal seal unit (10) comprising two hot-seal jaws (11, 12) displaceable against one another for generating transversal seams (13) at the tubular film (6), a cutting unit (14) for cutting off the generated tubular bags (15) from the tubular film (6), a mechanism (16) for holding the hot-seal jaws (11, 12), and a drive (17) for displacing the transversal seal unit (10), wherein the drive (17) comprises two linear motors (18, 19), the first linear motor (18) of which is provided for a displacement of the transversal seal unit (10) in a first direction, preferably vertically (20), and the second linear motor (19) serves for carrying out a displacement in a second direction, preferably horizontally (21), to displace a hot-seal jaw (11) in this direction, preferably to cause both hot-seal jaws (11, 12) to be displaced against one another by means of a gear (22), wherein the linear motors (18, 19) are interconnected by means of a connection, and each linear motor (18, 19) consists of a primary part (24, 26) and a secondary part (25, 27), characterized in that the connection is a cross formation (23), the two beams (28, 29) of which are arranged transversal to one another, that on each of the opposite sides of the cross formation (23), always one part (24, 25, 26, 27), respectively, of a different linear motor (18, 19) is attached on a different beam (28, 29), that on each of the opposite sides, one guideway (30, 31), respectively, is provided in parallel to a beam (28, 29), that one part (24, 25, 26, 27) of a linear motor (18, 19) is attached to a stationary holder (32), and its other part (24, 25, 26, 27) is attached to the one side of the cross formation (23), that one part (24, 25, 26, 27) of the other linear motor (18, 19) is attached on the other side of the cross formation (23), and its other part (24, 25, 26, 27) is displaceable relative to this part (24, 25, 26, 27) and is connected with the transversal seal unit (10), and that on each of the parts (24, 25, 26, 27) which are not attached to the cross formation (23), at least one cart (33), respectively, is provided for displacing the part (24, 25, 26, 27) along a guideway (30, 31).

2. The bagging machine according to claim 1, characterized in that each of the secondary parts (25, 27) of the linear motors (18, 19) are connected fixed with the cross formation (23).

3. The bagging machine according to claim 1, characterized in that the guideways (30, 31) are attached to the cross formation (23), wherein the guideways (30, 31) preferably comprise a hardened surface.

4. The bagging machine according to claim 1, characterized in that as a guideway (30, 31), two rails (34, 35) are provided which are arranged in parallel to one another.

5. The bagging machine according to claim 4, characterized in that at each part (24, 25, 26, 27) displaceable along a guideway (30, 31), four carts (33) are provided, wherein always two carts (33), respectively, are guided along a common rail (34, 35).

6. The bagging machine according to claim 1, characterized in that the parts (24, 25, 26, 27) connected fixed with the cross formation (23) are glued to the cross formation (23).

7. The bagging machine according to claim 1, characterized in that the cross formation (23) comprises on each of the opposite sides one material cut-out (36), respectively, with an edge (37) bordering the same.

8. The bagging machine according to claim 7, characterized in that the parts (24, 25, 26, 27) connected fixed with the cross formation (23) are each provided in a material cut-out (36), respectively.

9. The bagging machine according to claim 5, characterized in that the parts (24, 25, 26, 27) connected fixed with the cross formation (23) extend along the respective beam (28, 29) and run between the rails (34, 35).

10. The bagging machine according to claim 1, characterized in that the cross formation (23) consists of a light metal, in particular aluminum or magnesium.

11. The bagging machine according to claim 1, characterized in that at least one secondary part (25, 27) consists of a row of separate secondary sub-segments (40) arranged next to one another, wherein the secondary sub-segments (40) each are connected with the cross formation (23) by a fastening means (41).

12. The bagging machine according to claim 11, characterized in that each secondary sub-segment (40) is connected with the cross formation (23) via a bottom part or a housing (42).

13. The bagging machine according to claim 12, characterized in that the bottom parts or the housing (42), respectively, abut closely, or by forming a gap (43) to one another at room temperature, and that the material of the bottom parts or the housings (42), respectively, has a lower coefficient of linear expansion than the material of the cross formation (23).

14. The bagging machine according to claim 13, characterized in that as a material for the bottom parts or the housings (42), respectively, steel is provided, and as material of the cross formation (23), aluminum is provided.

15. The bagging machine according to claim 11, characterized in that the bottom parts or the housings (42), respectively, abut against one another at room temperature each time forming a gap (43).

* * * * *